US007497429B2

(12) United States Patent
Reynders et al.

(10) Patent No.: US 7,497,429 B2
(45) Date of Patent: Mar. 3, 2009

(54) DOCUMENT CARRIER AND SYSTEM FOR USE THEREWITH

(76) Inventors: Lisa A. Reynders, N7264 Chapel Dr., Whitewater, WI (US) 53190; Gayla Marie Gardenhire, 951 Overbrook Rd., Uniontown, KS (US) 66779

( * ) Notice: Subject to any disclaimer, the term of this patent is extended or adjusted under 35 U.S.C. 154(b) by 753 days.

(21) Appl. No.: 10/954,799

(22) Filed: Sep. 30, 2004

(65) Prior Publication Data

US 2006/0102704 A1 May 18, 2006

(51) Int. Cl.
*B65H 5/00* (2006.01)

(52) U.S. Cl. ..... 271/2; 229/71

(58) Field of Classification Search ..... 271/1, 271/2; 229/70, 71, 72; 40/661, 359
See application file for complete search history.

(56) References Cited

U.S. PATENT DOCUMENTS 3,531,628 A * 9/1970 White, Jr. ..... 235/487
3,576,972 A * 5/1971 Wood et al. ..... 235/487
3,588,456 A * 6/1971 McNabb ..... 235/487
3,593,913 A * 7/1971 Bremer ..... 229/68.1
4,822,017 A * 4/1989 Griesmyer ..... 271/2
4,869,485 A * 9/1989 Enix ..... 271/2
4,927,071 A * 5/1990 Wood ..... 229/71
4,934,587 A * 6/1990 McNabb ..... 229/71
5,755,433 A * 5/1998 Klein ..... 271/2

* cited by examiner

*Primary Examiner*—David H Bollinger
(74) *Attorney, Agent, or Firm*—Harry Weissenberger

(57) ABSTRACT

The construction of the present invention is suitable for use as a document carrier and is particularly adapted for the transporting of negotiable instruments such as checks and other items that are used to transfer funds, credits or the like through automated processing equipment such as readers, scanners, copiers and the like. The assembly of the present invention includes an internal pocket that is created through the use of a pair of translucent sheets affixed about an opening created in a standard format sheet, such as a sheet having a dimension of 8½" by 11".

11 Claims, 7 Drawing Sheets

DOCUMENT CARRIER AND SYSTEM FOR USE THEREWITH

CROSS-REFERENCES TO RELATED APPLICATIONS

None.

FIELD OF THE INVENTION

The present invention relates to the field of document carriers or business forms portage devices that are utilized in the processing or handling of documents that may not otherwise be capable of independent processing through reading, printing or sorting equipment or which may facilitate the more efficient scanning, printing or completing the action or transaction related to the document. More particularly, the document carrier of the present invention utilizes a unique transparent or translucent pocket construction that permits the ready use and reuse of the form intermediate as a document carrier, handling tool or portage device through processing equipment. The document carrier of the present invention is sized and configured so as to be readily transported by standard sheet feeders, trays or the like.

BACKGROUND OF THE INVENTION

The marketing of various products and services in today's retail and wholesale environments has created an upsurge in the use of redemption certificates, coupons, rebate checks, tags, identification confirmation pieces and the like. Often such articles range in a variety of sizes due to the delivery mechanism that was used in providing the article to the intended consumer or recipient. In addition, with the rise in business products for home use, the ability to prepare business forms such as checks, coupons and other non-standard configuration forms and the like on an individual basis increases demand for such products and spurs usage by consumers. However, there are difficulties in handling and processing such articles by clearing houses, redemption centers and the like as to do so may require supplement software or additional formatting of printing or processing equipment.

In addition to the foregoing business products, other negotiable instruments may need to be treated or handled separately from those received in the normal course of business. Such special handling may arise out of the document having been partially torn or ripped during its processing, the document may be an odd size, loss or unreadable MICR numbers which aid in the routing and payment and satisfaction of the sums referenced in the negotiable instrument and other difficulties with the processing of checks, bank drafts and other documents.

One such prior art solution for handling documents is marketed under the trademark LASER TAXI® by Hico Products or Barrington, Ill. and covered by U.S. Pat. No. 5,087,238. This product uses one or more strips of tape to which documents are attached and then a flap is folded over the document while the document is processed through sorting equipment. One of the incumbent difficulties associated with this particular product is that the adhesive contained on the tape has a tendency to loose its adhesive tack strength relatively quickly. In addition, in order to be able to reuse the device, the user must locate the release strip that originally covered the adhesive strips and then carefully reposition the strip over the adhesive tape. This can be a frustrating exercise in that it requires some care in aligning the strip(s) with the adhesive in order that the form can be saved and reused later. In the event that the release strip is lost or misplaced, then the form likely becomes unusable as it will adhere to any surface that the form comes into contact with and creates a nuisance in the office environment in that the form cannot simply be placed in areas with other papers as the form with its exposed adhesive will stick to the other papers which may potentially cause such papers to be torn upon the attempted removal of the carrier form.

Other prior art solutions include the addition of a label that is attached to check or other document to be processed. While this increases the surface area of the document that is to be handled, it requires the user to find the labels and where the label covers the machine readable indicia, the label must first be printed with the information that is now concealed by the auxiliary label. In addition, the use of such supplemental labels may cause the business form or other document to splay out of alignment with the printing, reading or processing device which can cause improper reads, rendering of incorrect fields and other problems.

Still other prior art solutions include U.S. Pat. No. 6,090,470 which provides for a sheet of paper having an exposed adhesive grid pattern to temporarily hold odd sized documents for scanning. As suggested earlier, with the exposed adhesive pattern, the adhesive may inadvertently stick or adhere to areas or documents that were not intended.

Another prior art solution is disclosed in U.S. Pat. No. 5,725,254 which utilizes a tab system that is intended to hold documents of non-standard configurations in position so that the document may be read by a facsimile machine. The difficulty with this construction is that the user is then forced to move the tabs into an alternating arrangement so that the form is held in position.

A yet still further prior art solution is marketed under the trademark MICRA® by Micra Document Carrier Division of Milwaukee, Wis. and described in U.S. Pat. No. 3,043,506. The construction includes an opaque sheet to which a glassine or other transparent material is adhered. This envelope type construction has a length of approximately 8¾" by 4". The problem associated with this construction is that the construction cannot be easily handled by sheet fed equipment in that the envelope has a non-standard sheet size. In addition, the construction cannot be used to simultaneously scan both sides of the document and requires the user to remove the document, invert the document and then reinsert the document for subsequent scanning, which is a time consuming process.

What is needed therefore is a document carrier that can be handled easily by sheet fed equipment and which enables the simultaneous scanning of both sides of the document in a single pass of the document carrier through the processing or handing equipment.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

The present invention relates to the field of document carriers that are used to transport or facilitate the processing of odd sized documents through scanners, readers, copiers or the like such that the indicia that is on the document may be readily captured by automated processing equipment that utilizes standard feeding trays or bins.

The construction of the document carrier includes a transparent or translucent pocket that is formed internally of the outer perimeter of a carrier sheet that facilitates the processing of a non-standard sized document as defined herein through scanners, readers copiers or the like without the necessity of having to modify the infeed or sheet trays.

In one exemplary embodiment a document carrier is provided and includes a substantially opaque sheet is provided that has an outer dimension of approximately 8½" by 11". The opaque sheet has front and rear faces, transversely extending edges and longitudinally extending sides. The opaque sheet has an opening, disposed internally of the outer perimeter that is sized and configured to receive a document. The opening has a perimeter with dimensions less than 7½" by 10½".

In the presently described embodiment, a first translucent sheet is applied over the opening on the rear side of the opaque sheet so as to cover the opening and extend beyond each of the edges of the perimeter of the opening. The first translucent sheet is adhered to the opaque sheet by a pattern of adhesive that extends about and slightly beyond the perimeter of the opening to effectively seal the first translucent sheet to the opaque sheet.

The construction of the presently described embodiment also includes a second translucent sheet that is applied over the opening on the front face of the opaque sheet so as to cover the opening and extend beyond the perimeter of the opening. The second translucent sheet is adhered to the opaque sheet by a "U" shaped pattern of adhesive extending along three sides of the perimeter so as to create an opening between an edge of the opening and the second translucent sheet.

The opaque sheet of this embodiment with the first and second translucent sheets attached form a pocket that is disposed inwardly of the outer dimensions of the opaque sheet for carrying documents having dimensions less than 7½" by 10½".

In a still further exemplary embodiment of the present invention a document carrier for processing documents having dimensions less than 7½" by 10½" is described and includes a document that has first and second faces. The document may or may not be provided with indicia on at least one of the first and second faces and the document having a dimension less than 7½" by 10½".

In this presently described embodiment, the document carrier has an opaque sheet that has front and rear faces and an outer dimension of approximately 8½" by 11". The opaque sheet has an inner opening that has a dimension of not more than 7½" by 10½". The document carrier further includes a pair of translucent sheets with one of the sheets affixed to each face of the opaque sheet so that each of the translucent sheets cover the opening, one on each side of the opening. One of the translucent sheets is affixed permanently about a perimeter of the opening on one side and the other of the translucent sheets is affixed about the opening by a "U" shaped pattern of adhesive so as to create an unsealed edge. The translucent sheets cooperate to form a pocket about the opening.

Continuing with a brief discussion of the presently described exemplary embodiment, the document is inserted in the pocket and rests between the translucent sheets such that the document may be scanned, read, or captured by automated processing equipment having standard sheet feeding equipment.

In yet a still further exemplary embodiment of the present invention, a system for scanning, reading or copying non-standard sized documents, is described and includes at least one document having a dimension less than 7½" by 10½". The document has readable indicia which may be human or machine readable indicia.

In the presently described embodiment, a document carrier is also provided. The document carrier has an opaque sheet that has front and rear faces. The sheet has an outer dimension of approximately 8½" by 11" and has an inner opening that has a dimension of not more than 7½" by 10½". The document carrier further includes a pair of translucent sheets with one sheet affixed to each face of the opaque sheet so that each of the translucent sheets covers the opening. One of the translucent sheets is affixed permanently about a perimeter of the opening and another of the translucent sheets is affixed about the opening by a "U" shaped pattern of adhesive so as to create an unsealed edge. The translucent sheets in cooperation with the opaque sheet form a pocket.

At least one piece of automated processing equipment having standard sheet feeding equipment is provided in the system of the present invention for reading, scanning or copying the document. The document is inserted in the pocket and rests between the translucent sheets such that the document may be scanned, read, or captured by the automated processing equipment.

In each of the foregoing embodiments each of translucent sheets have first and second transversely extending end edges and first and second longitudinally extending sides and at least one of the longitudinally extending sides of one of the sheets are coterminous with the longitudinally extending sides of the opaque sheet.

In an alternative arrangement at least one of the transversely extending edges and longitudinally extending sides of the opaque sheet is provided with a leveling aid on one of the front or rear faces of the first sheet such that a stack of such document carriers will remain substantially quadrate in configuration when placed in a sheet infeed tray for automated processing equipment.

The document that may be used in connection with the document carrier of the foregoing embodiment may be selected from a group that includes negotiable instruments, redemption certificates, coupons, rebate checks, tags, identification confirmation pieces and combinations thereof.

These and other objects of the invention will become clear from an inspection of the detailed description of the invention and from the appended claims.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE INVENTION

Figure 1:
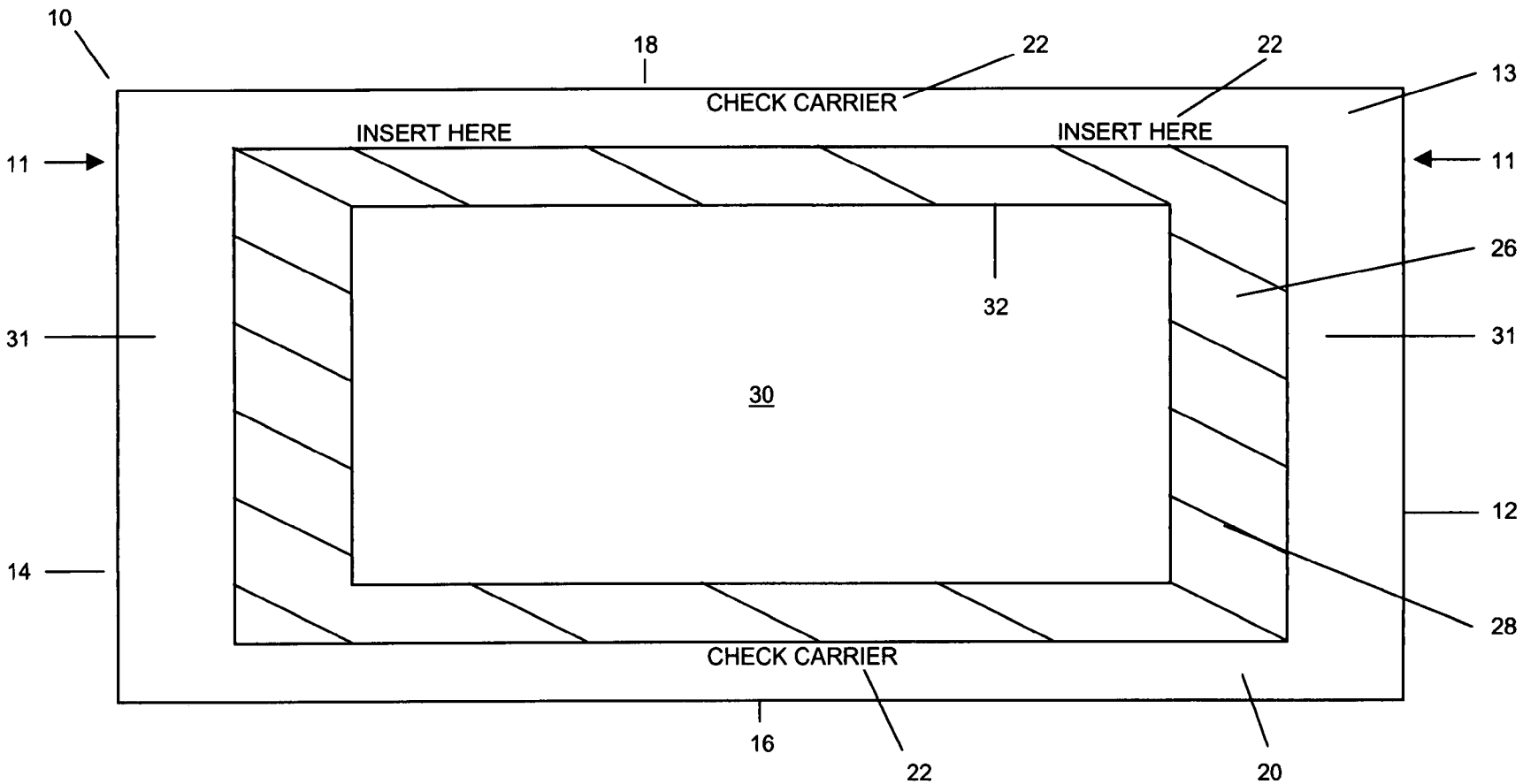
FIG. 1 depicts the front face of the document carrier of the present invention with an open edge provided for insertion of a document.

The present invention is now illustrated in greater detail by way of the following detailed description which represents the best presently known mode of carrying out the invention. However, it should be understood that this description is not to be used to limit the present invention, but rather, is provided for the purpose of illustrating the general features of the invention.

As used herein, the term "business form" is used to refer to checks, coupons, tickets, passes, tags, certificates and any other document that is intended to undergo processing so as to complete a transaction, such as through clearing houses, banks, redemption centers and the like. Such business forms may typically be provided with machine readable indicia which may include bar codes, MICR numbering, as well as human readable alpha and numeric codes and patterns and combinations thereof The "equipment" that is contemplated for use with the present invention and combination includes but is not limited to sorting, printing, processing, handling, scanning, reading and combinations thereof that use standard sheet feeding trays, handlers and inserters. Standard sizes include A4, 8½"×11", 8½"×14", 11"×17".

As used herein the term "pattern of adhesive" refers to continuous strips, lines, shapes, spots or elements, discontinuous segments, spots, shapes or elements as well as regular and irregular placement of such items. Patterns may also refer to combinations of the above mentioned items such that one pattern may be a continuous strip, another segmented elements or an irregular placement of dots or the like. Any combination of patterns is possible depending on the desire of the manufacturer or the end user. In additions, the patterns can be prepared in order to accommodate a particular theme, season, event, trade dress, and the like, such as arrows to illustrate the opening of the pocket area of the document carrier.

As used herein, the term "non-standardized document" refers to a document that has a size other than the standard paper formats of A4, 8½"×11", 8½"×14", 11"×17".

Unexpectedly, it has been found that a relatively inexpensive and easy to use construction can be fabricated through the use of a pair of substantially equally sized translucent sheets of material that are affixed to each face of a substantially opaque sheet having an opening to form a pocket through which each side of a document, such as a check may be inserted. The translucent sheets of the present invention generally have a size of about 5" by 11" but other dimensions are of course within the scope of this invention. The sheets of translucent material may generally be glassine type films, such as a 10 pound glassine stock, plastic sheets or films or other materials that have a translucent or transparent characteristic. The substantially opaque sheet may be selected from suitable stock material such as cellulosic stock, such a bond paper or may be synthetic films (e.g. polyester based materials) or metalized films (e.g. aluminum foils). Through the use of a relatively standard size or configuration, the carrier of the present invention can be used to process documents through a printer or other processing equipment without requiring modification or adaptation of the sheet infeed trays. In this relatively standard sized configuration, the document carrier assembly can by used in high speed scanners, readers, copiers or the like in order to be able to efficiently process products that would otherwise require additional formatting or software in order to process the communication piece. The present invention overcomes the need for such additional software and enables the ready capture of odd sized materials that require redemption, verification or the like.

Attention is now directed to FIG. 1 of the instant specification in which the document carrier is generally depicted by reference to numeral 10. The carrier assembly 10 has a front face 13 and a back face 15 (see FIG. 2). The carrier assembly has longitudinally extending sides 12 and 14, and transversely extending edges 16 and 18. The document carrier 10 is constructed from a substantially opaque sheet 20, which is preferably cellulosic material, and may be provided with useful indicia and advertising designated by reference numeral 22. The indicia 22 that is provided in the drawing includes "Check Carrier" and user indicia "insert here" but it should be understood that any indicia may be provided and that such indicia may be human and/or machine readable. The sheet 20 preferably has a standard sheet dimension such as A4, 8½"×11", 8½"×14", 11"×17" with 8½"×11" being preferred.

The front face 13 of the sheet 20 is provided with a first transparent or translucent sheet 26. Preferably, the sheet is selected from a glassine material but could be any suitable material such as plastic films, that would enable the contents of the pocket to be viewed, scanned, read, captured, etc. by any suitable automated processing equipment which will be discussed in connection with subsequent FIGURES.

It will be understood that the sheet 26 will have transversely extending edges and longitudinally extending sides. The first sheet of transparent or translucent material 26 is secured to the opaque sheet 20 through a "U" shaped pattern of adhesive 28. The shape of the pattern enables one edge, here a transverse edge to be free or not sealed to sheet 20 such that documents may be inserted under the transparent sheet 26.

The first transparent sheet 26 is applied over an opening 30 in the opaque sheet. The opening has a perimeter 32 which defines the dimensions of the opening which range from 7½"×10½" to approximately 4"×9" which is preferred. The adhesive pattern 28 of the first sheet 26 extends beyond the perimeter and secures the first sheet 26 to the opaque sheet 20. The adhesive pattern 28 should be applied such that no adhesive is exposed either in the outer edge of the first sheet 26 or in the area of the opening 30 so as to not cause sticking or feeding problems in handling documents to be scanned or alternatively in processing documents through automated equipment.

As can be seen from FIG. 1, the first transparent sheet 26 is affixed in such a manner to opaque sheet 20 that the longitudinally extending side edges are spaced inwardly from the longitudinal edges 12 and 14 of the opaque sheet 20 as is shown by space 31.

Preferably, the adhesive is a permanent adhesive so that the translucent or transparent sheet remains affixed or adhered to the opaque sheet and thus avoids difficulties related to sheet separation as may occur during processing or handling of the carrier. The adhesive may be clear, colored or opaque depending on the requirements of the manufacturer or end user customer.

Figure 2:
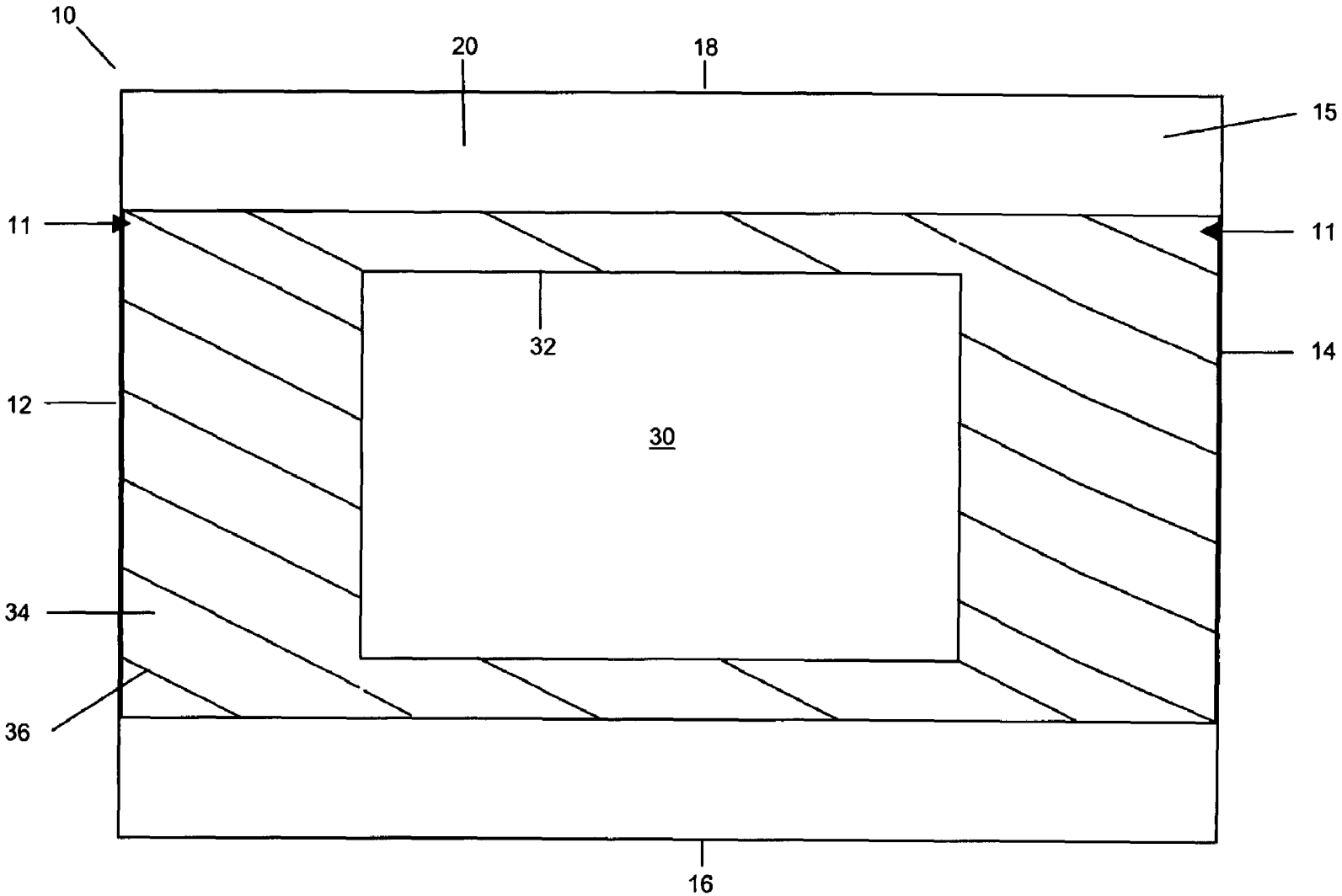
FIG. 2 illustrate the rear face of the document carrier of the present invention and showing the coterminous longitudinal edges of the sheet and translucent sheet.

Turning now to FIG. 2 of the present invention, the rear face 15 of the document carrier 10 is presented. As can be seen, a second transparent or translucent sheet 34 is affixed to the opaque sheet 20 through use of a pattern of adhesive 36. The second sheet 34 is preferably secured completely around the perimeter 32 of the opening 30 so as to create a sealed back enclosure for the pocket that is being formed by the combination first sheet 26, opening 30 and second translucent sheet 34.

As can be seen from FIG. 2, the longitudinal edges of the second translucent sheet 34 are coterminous with the opaque sheet 20 along longitudinal sides 12 and 14.

Figure 3:
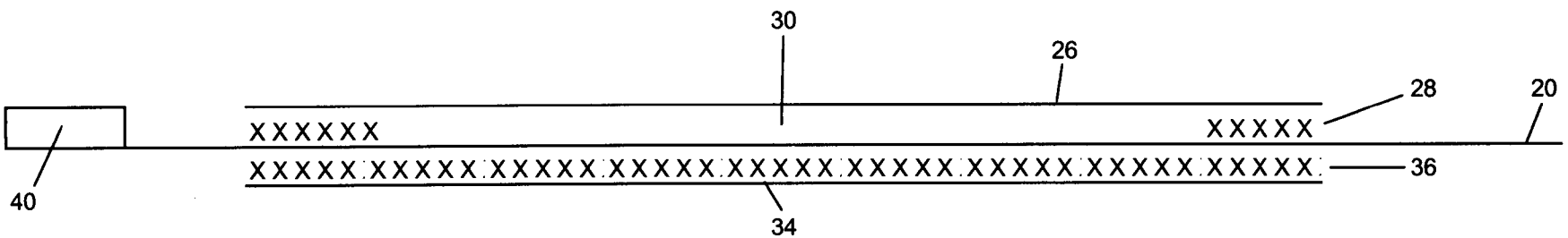
FIG. 3 provides a cross sectional view of the present invention showing the opening along line 11 in FIGS. 1 and 2.

Turning now to FIG. 3 of the present invention, a cut away of the carrier assembly that has been taken along line 11 in FIGS. 1 and 2 is provided. The first translucent sheet 26 is shown adhered to the opaque sheet 20 through the use of the "U" shaped pattern of adhesive 28 which creates an unsealed edge, in the transverse direction so that documents may be inserted into the pocket that has been created. The second translucent or transparent sheet 34 is fully secured to the opaque sheet 20.

Each of the transparent or translucent sheets 26 and 34 used in the creation can have a dimension ranging from 8½"×11" to approximately 4½"×9½", or just large enough to extend beyond the perimeter of the opening in the sheet 20 or any size in between. The sheets are preferably a 10 pound glassine stock, which may have an antistatic coating applied to the sheet to facilitate the sliding of the sheets from one another when a series of sheets are placed in a stack FIG. 3 is also used to show the use of a leveling aid 40 which may also be used as a feed assist to facilitate the in feeding of the document carrier to an automated equipment component. The leveling aid 40 is used to make up for the difference in thickness of the carrier created by adhering or adhesively affixing the translucent or transparent sheets to the opaque assembly. The use of the leveling aid 40 would only be used if transparent or translucent sheets that are less than the length and width of the opaque sheet are used. The leveling aid 40 may be placed along any transverse or longitudinal edge and more than one aid may be used if necessary. The aid can be created through the use of adhesive strips, coated patterns of material or any other coating or strip material that has a sufficient thickness to allow the sheets to lay substantially flat in a stack.

Figure 4:
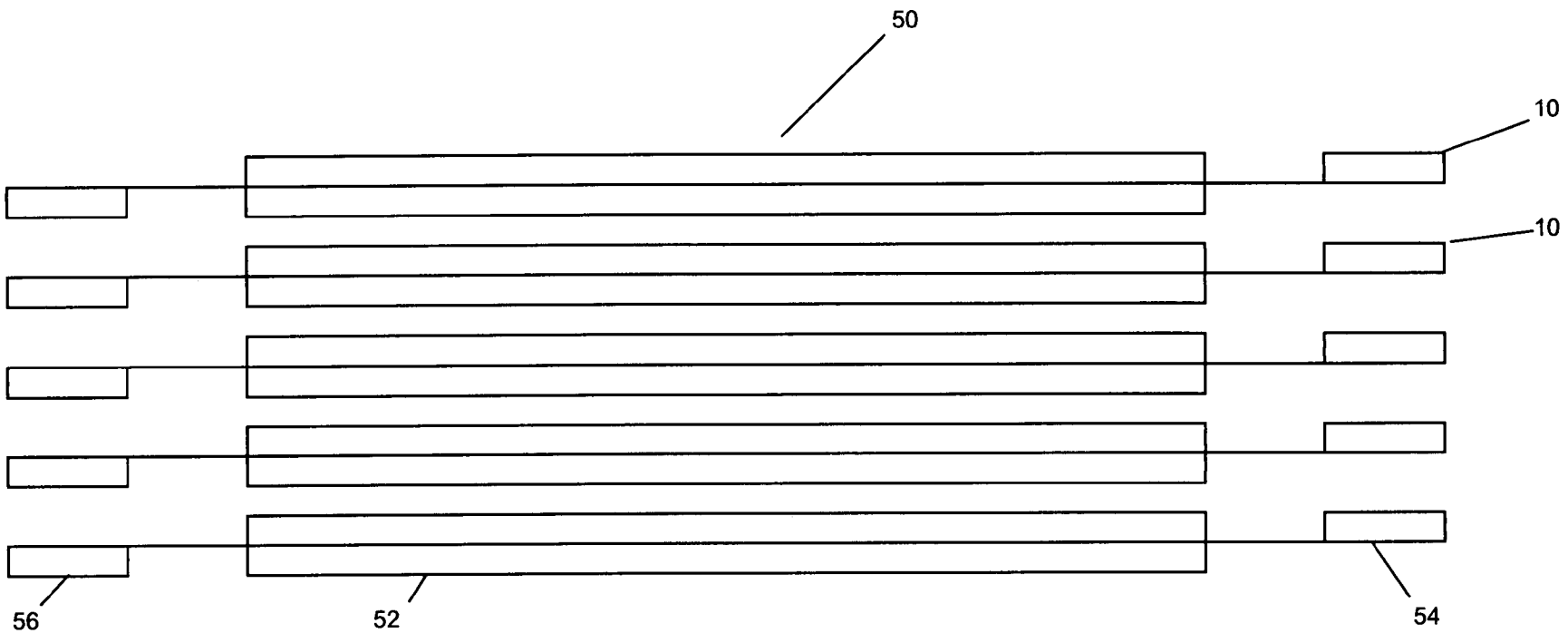
FIG. 4 shows a substantially quadrate stack of document carriers having leveling aids.

FIG. 4 provides a side illustration of series of document carriers 10 placed in a stack 50. As can be seen from FIG. 4, each of the carriers 10 has a pocket area 52, the formation of which has been previously described and one or more leveling aids 54 and 56 to maintain the stack 50 in a substantially quadrate configuration. As provided in FIG. 4, the leveling aids 52 and 54 are provided on opposite end edges of each of the carriers 10 to compensate for the differing thicknesses of the form assembly.

With certain high speed processing equipment, maintaining a stack in a quadrate configuration can eliminate a phenomenon known as "pad lean" thereby allowing more sheets to be loaded into the infeed trays so as to be able to process the document carriers at a relatively high rate of speed.

Figure 5:
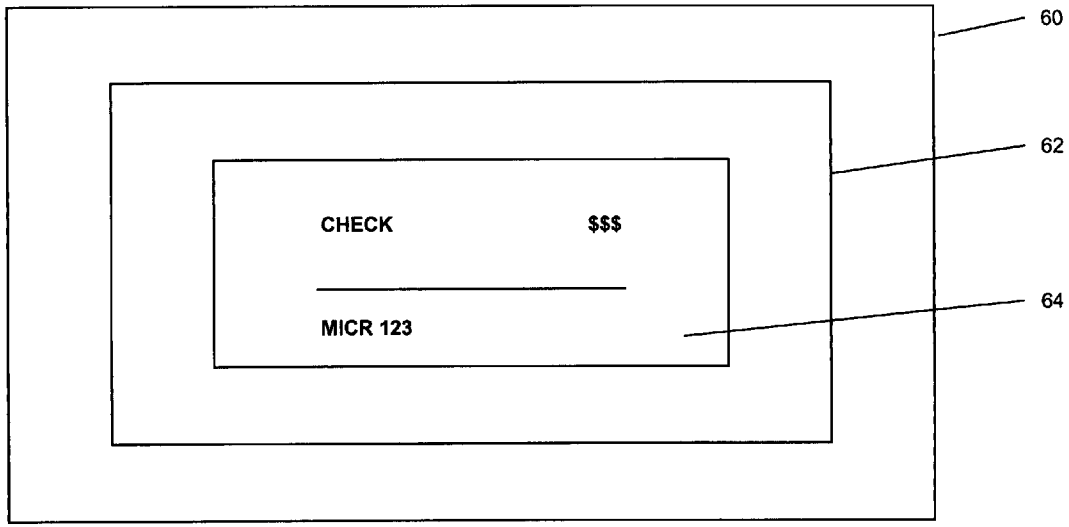
FIG. 5 provides a front view of the document carrier showing a document being carried thereby.

FIG. 5 of the present invention depicts the document carrier 60 showing the pocket/window 62 having a document 64, in this illustration a check inserted into the pocket 62 so that the document is visible through the transparent sheet.

Figure 5A:
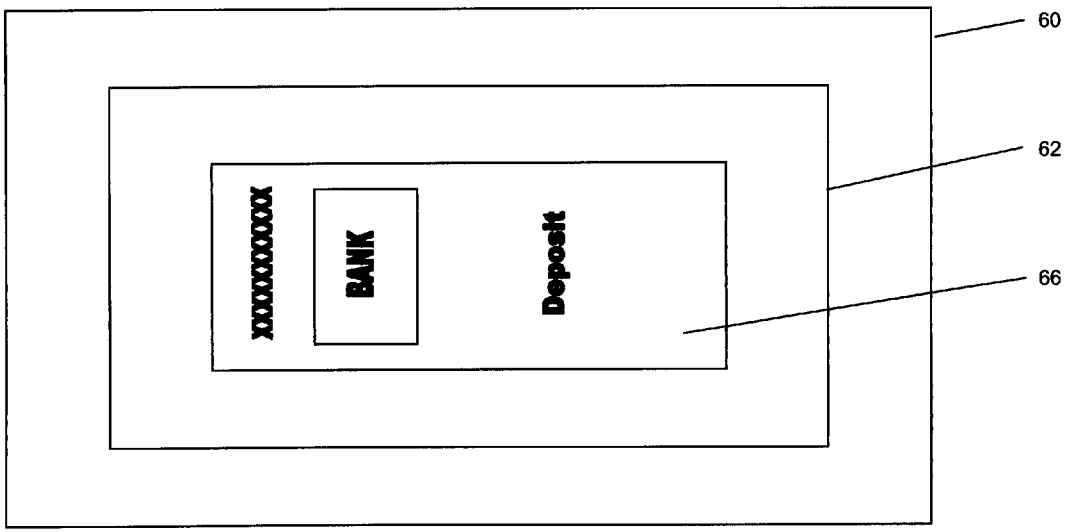
FIG. 5A depicts the back view of the document carrier showing the back or opposite side of the document being carried thereby.

FIG. 5A provides the reverse or back side of the document carrier 60 into which the opening 62 has the reverse side or endorsement panel of the document 66 shown.

By providing transparent or translucent sheets on each side of the opaque carrier sheet 20 and over the area of the opening, any document that is inserted into the carrier assembly can have each side of the document scanned, read or copied, without the necessity of removing the document from the carrier, inverting the document and then reinserting the document in the carrier so as to be able to scan, read or copy the other side. In processing negotiable instruments such as checks, there is a desire to not only capture the face of the check but to also obtain a copy of the endorsement and other processing indicia that appear on the reverse side of the check.

Figure 5B:
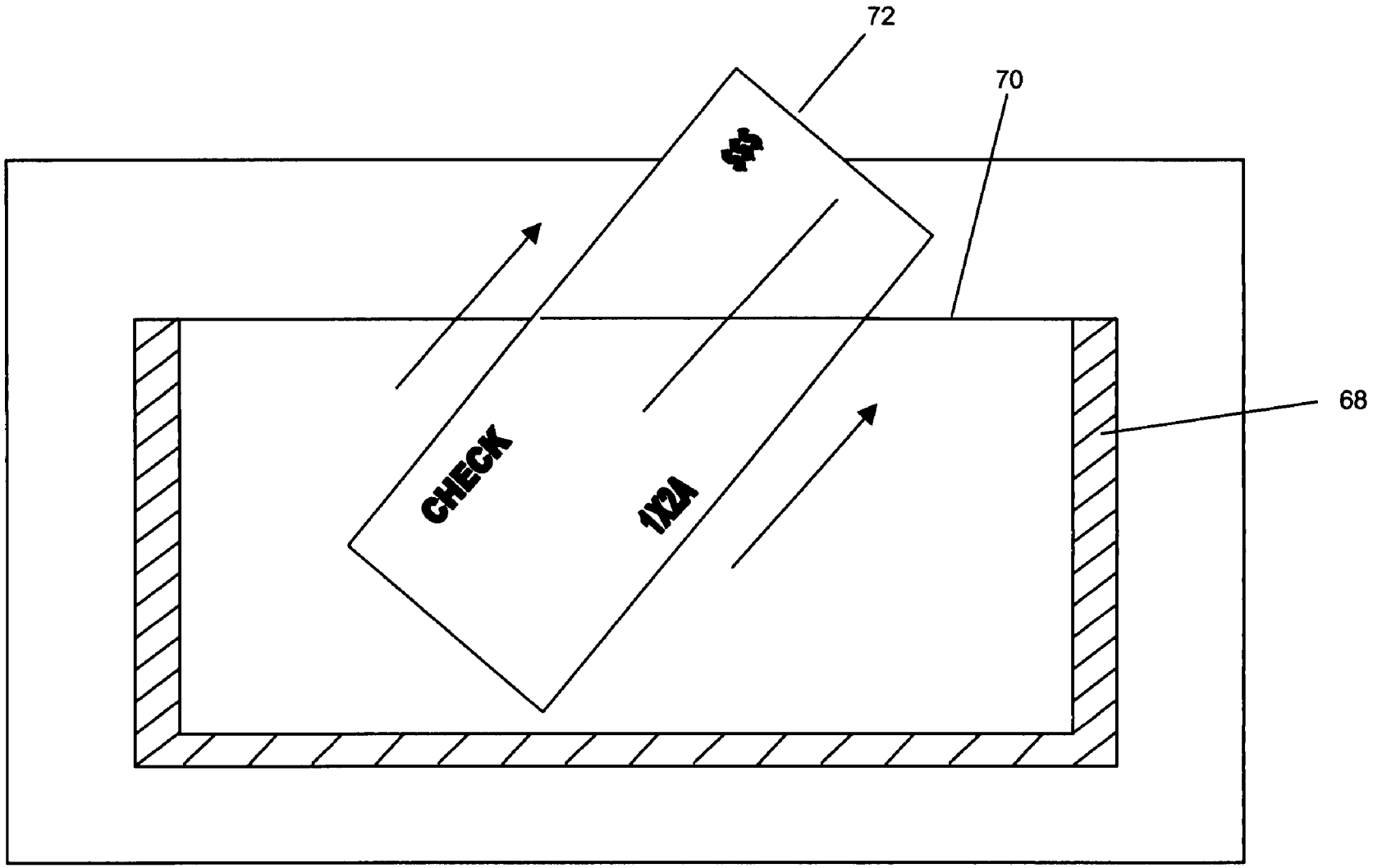
FIG. 5B illustrates the use of the document carrier and provides a document being removed from the carrier pocket.

FIG. 5B is provided to demonstrate the ease of use of the present invention in which the "U" shaped pattern of adhesive 68 provides an unsealed edge 70 (one edge of the transparent or translucent sheet is not sealed to the opaque sheet) so that a document 72 may be easily removed from the document carrier through the unsealed edge.

Figure 6:
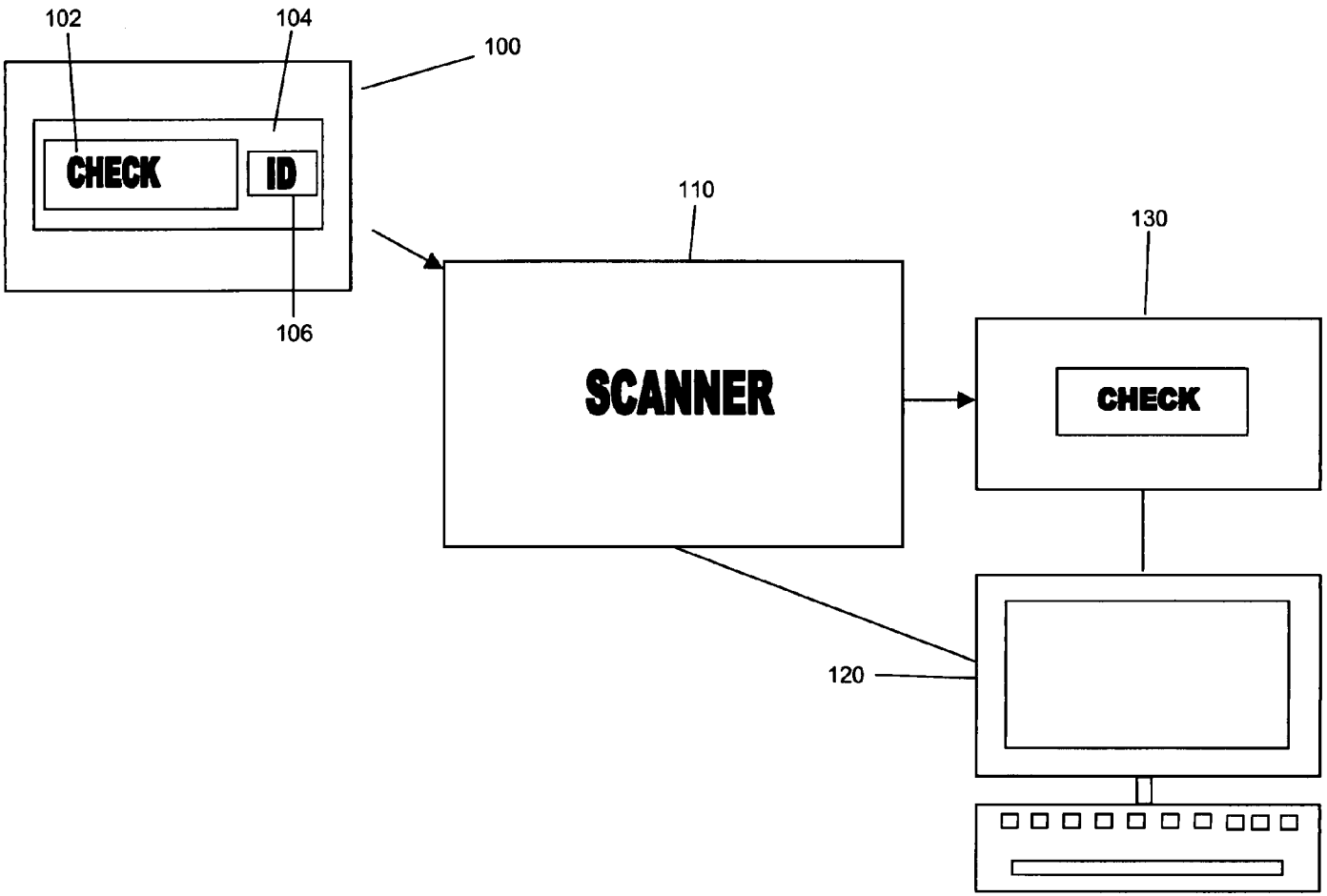
FIG. 6 depicts a schematic of the system used in connection with the present invention.

FIG. 6 of the instant specification provides a schematic of a system that may be used in connection with the document carrier of the present invention. A document carrier 100 contains at least one document 102 that is visible through the transparent sheet 104 that covers the opening as previously discussed herein. A second document 106 is also provided in the pocket, which in this particular instance includes an identification tag or scan series label so that the scanned, copied, read or imaged document can be traced back to a particular sequence in the event there is an error in the sequence.

The document carrier 100 is then fed to a piece of processing equipment which in this example is a document scanner 110. The document carrier can be fed using conventional feed trays, inserters or may be placed on the processing equipment manually. The document is then scanned by the equipment 110.

The equipment will preferably be connected to a computer 130 which may be at the same site as the processing equipment or may be at a remote location. The connection may be done over a global communications network or through a local or wide area network. The computer 120 and possibly the processing equipment may be connected to a display 130 so that the image of the scanned document may be displayed for correctness, investigation or such other purpose as may be made of the captured image.

It will thus be seen according to the present invention a highly advantageous document carrier for porting or transporting odd sized documents such as negotiable instruments through processing equipment has been provided. While the invention has been described in connection with what is presently considered to be the most practical and preferred embodiment, it will be apparent to those of ordinary skill in the art that the invention is not to be limited to the disclosed embodiment, that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

The invention claimed is:

1. A document carrier, comprising;

a) a substantially opaque sheet having outer dimensions of approximately 8½" by 11", said opaque sheet having front and rear faces, transversely extending edges and longitudinally extending sides, said opaque sheet having an opening sized and configured to receive a document, said opening having a perimeter with dimensions less than 7½" by 10½";

b) a first translucent sheet is applied over said opening on said rear face of said opaque sheet so as to cover said opening and extend beyond each of said edges of said perimeter of said opening, said first translucent sheet is adhered to said opaque sheet by a pattern of adhesive extending about and slightly beyond the perimeter of said opening to effectively seal said first translucent sheet to said opaque sheet; and c) a second translucent sheet applied over said opening on said front face of said opaque sheet so as to cover said opening and extend beyond said perimeter of said opening, said second translucent sheet is adhered to said opaque sheet by a "U" shaped pattern of adhesive extending along three sides of said perimeter so as to create an opening between an edge of said opening and said second translucent sheet; and d) said opaque sheet with said first and second translucent sheets attached form a pocket that is disposed inwardly of said outer dimensions of said opaque sheet for carrying documents having dimensions less than 7½" by 10½".

2. A document carrier as recited in claim 1, wherein said first translucent sheet is printable.

3. A document carrier as recited in claim 1, wherein said opening is approximately 4" by 9".

4. A document carrier as recited in claim 1, wherein at least one of said transversely extending edges and longitudinally extending sides is provided with a leveling aid on one of said front or rear faces of said first sheet such that a stack of such document carriers will remain substantially quadrate in configuration when placed in an infeed tray for automated processing equipment.

5. A document carrier as recited in claim 1, wherein each of said first and second translucent sheets have substantially equal dimensions.

6. A document carrier as recited in claim 5, wherein each of said first and second translucent sheets have a dimension of approximately 5" by 11".

7. A document carrier as recited in claim 1, wherein each of said first and second sheets have first and second transversely extending end edges and first and second longitudinally extending sides and at least one of said longitudinally extending sides of one of said first and second sheets are coterminous with said longitudinally extending sides of said first opaque sheet.

8. In combination with documents having dimensions less than 7½" by 10½" a document carrier for processing the same, comprising;

a) a document having first and second faces, said document having indicia on at least one of said first and second faces; said document having a dimension less than 7½" by 10½";

b) a document carrier, said document carrier having an opaque sheet having front and rear faces an outer dimension of 8½" by 11" and having an inner opening having a dimension of not more than 7½" by 10½", said document carrier further including a pair of translucent sheets with one sheet affixed to each face of said opaque sheet so that each of said translucent sheets cover said opening, one of said translucent sheets is affixed permanently about a perimeter of said opening and another of said translucent sheets affixed about said opening by a "U" shaped pattern of adhesive so as to create an unsealed edge, said translucent sheets forming a pocket; and c) said document is inserted in said pocket and rests between said translucent sheets such that said document may be scanned, read, or captured by automated processing equipment having standard sheet feeding equipment.

9. A system for scanning, reading or copying non-standard sized documents, comprising;

a) at least one document having a dimension less than 7½" by 10½", said document having readable indicia;

b) at least one document carrier, said document carrier having an opaque sheet having front and rear faces an outer dimension of 8½" by 11" and having an inner opening having a dimension of not more than 7½" by 10½", said document carrier further including a pair of translucent sheets with one sheet affixed to each face of said opaque sheet so that each of said translucent sheets cover said opening, one of said translucent sheets is affixed permanently about a perimeter of said opening and another of said translucent sheets affixed about said opening by a "U" shaped pattern of adhesive so as to create an unsealed edge, said translucent sheets forming a pocket;

c) at least one piece of automated processing equipment having sheet feeding equipment for reading, scanning or copying said at least one document; and d) said at least one document is inserted in said pocket and rests between said translucent sheets such that said document may be scanned, read, or captured by said at least one piece of automated processing equipment.

10. A system as recited in claim 9, wherein the system includes a computer and display to illustrate the at least one document scanned by the automated processing equipment.

11. A system as recited in claim 9, wherein a stack of document carriers is provided.

* * * * *